United States Patent [19]

Krenzer

[11] Patent Number: 5,003,677

[45] Date of Patent: Apr. 2, 1991

[54] METHOD AND APPARATUS FOR PROCESSING A TEXTURED YARN

[75] Inventor: Eberhard Krenzer, Ennepetal-Ruggeberg, Fed. Rep. of Germany

[73] Assignee: Barmag AG, Remscheid, Fed. Rep. of Germany

[21] Appl. No.: 359,101

[22] Filed: May 31, 1989

[30] Foreign Application Priority Data

Jun. 1, 1988 [DE] Fed. Rep. of Germany ..... 3818609
Jul. 15, 1988 [DE] Fed. Rep. of Germany ..... 3824030

[51] Int. Cl.[5] ..... D06B 1/02; D01D 5/22; D02G 1/00

[52] U.S. Cl. ..... 28/220; 28/167; 28/254; 28/258; 28/271; 28/283

[58] Field of Search ..... 28/167, 220, 254, 258, 28/271, 283

[56] References Cited

U.S. PATENT DOCUMENTS

| | | | |
|---|---|---|---|
| 3,433,008 | 3/1969 | Gage | 28/271 X |
| 4,338,776 | 7/1982 | Krenzer | 57/246 |
| 4,457,034 | 7/1984 | Simmen . | |
| 4,598,538 | 7/1986 | Moore, Jr. | 57/7 |
| 4,608,814 | 9/1986 | Moore, Jr. et al. | 57/7 |
| 4,731,218 | 3/1988 | Damhorst et al. | 264/129 X |
| 4,829,757 | 5/1989 | Canton . | |

FOREIGN PATENT DOCUMENTS

| | | |
|---|---|---|
| 1435640 | 4/1973 | Fed. Rep. of Germany . |
| 2419617 | 10/1975 | Fed. Rep. of Germany . |
| 2638795 | 3/1977 | Fed. Rep. of Germany . |
| 2749867 | 5/1979 | Fed. Rep. of Germany . |
| 3122591 | 4/1982 | Fed. Rep. of Germany . |
| 3713455 | 11/1987 | Fed. Rep. of Germany . |
| 1000041 | 8/1965 | United Kingdom . |
| 1546070 | 5/1979 | United Kingdom . |

OTHER PUBLICATIONS

"Die Texturierung von Chemiefaden im Luftstrom", Textil-Praxis, Aug., 1969, pp. 515-520.

J. Kessler, Wattwil; "Umbau von FD-Texturierung auf das Luftblasverfahren"; *Chemiefasern/Textilindustrie;* Oct. 1983; pp. 712 and 713.

*Primary Examiner*—Werner H. Schroeder
*Assistant Examiner*—Bradley Kurtz DeSandro
*Attorney, Agent, or Firm*—Bell, Seltzer, Park & Gibson

[57] ABSTRACT

A method and apparatus for processing a synthetic continuous filament textured yarn is disclosed, and wherein the yarn is wetted prior to entering the texturizing nozzle. To effect a uniform and controllable wetting, the yarn is passed over a guide surface so that the filaments are laterally spread apart, and a jet of water is directed onto the advancing yarn from a direction opposing the guide surface.

19 Claims, 5 Drawing Sheets

METHOD AND APPARATUS FOR PROCESSING A TEXTURED YARN

BACKGROUND OF THE INVENTION

The present invention relates to a method and apparatus for processing a synthetic continuous filament yarn, and wherein the yarn is wetted prior to its entry into an air texturing nozzle.

DE-OS 31 22 591 discloses a yarn texturizing process wherein a textile yarn is guided over a surface before it enters into an air texturing nozzle. To this end, a bore terminates in the front surface, and is connected with a fluid tank, and the fluid which is applied to the yarn flows out of the bore due to its inherent static pressure. A disadvantage of this method is that the pressure level is limited, and as a result of the low pressure level, there is a risk of clogging the outlet opening. Furthermore, it will in the long run be impossible to adjust the pressure exactly to the absorbability of the yarn. An irregular wetting of the yarn leads also to an irregular texturing. If the pressure level is increased, so as to avoid the risk of clogging, a water jet will be formed, which attempts to displace the yarn, and the yarn is thus non-uniformly moistened. Further, the yarn is supplied with the liquid from only one side of the yarn.

DE-OS 33 45 336 and U.S. Pat. Nos. 4,598,538 and 4,608,814 disclose a texturizing process wherein the yarn is advanced through a water bath before it reaches the texturing nozzle. Although this method accomplishes a uniform moistening of the yarn, it requires measures to keep the water bath clean. Furthermore, the consumption of water by soaking the yarn in a water bath is higher than it is necessary for the quality of the texturizing process. DE-PS 27 49 867 and U.S. Pat. No. 4,338,776 disclose an air texturing process. Air texturing nozzles are, for example, described in "Texturierung von Chemiefaden im Luftstrom" Textilpraxis 1969, page, 515, by Lunenschioss et al.

In contrast to the above processes, it is an object of the present invention to avoid the risk that the water outlet opening clogs, and yet to moisten the advancing yarn with an amount of water provided therefor. Another object of the invention is to carry out a uniform wetting of the yarn in a precisely measured quantity according to the fluid requirements, it being intended on the one hand to achieve a good impregnation, and on the other hand to avoid an excessive wetting of the yarn.

SUMMARY OF THE INVENTION

The above and other objects and advantages of the present invention are achieved in the embodiments illustrated herein by the provision of method and apparatus which includes advancing the yarn along a path of travel, guiding the advancing yarn across a guide surface in a tensioned condition, wetting the advancing yarn by directing a jet of liquid onto the yarn as it advances across the guide surface and from a direction generally opposing the guide surface, and guiding the wetted yarn through an air texturizing nozzle to impart bulk to the wetted yarn.

An advantage which results from the present invention is the fact that it is possible to supply to the advancing yarn the exact amount of water, which is optimally suitable for the subsequent texturing process. Also, the jet exiting under pressure entrains all particles which would clog the supply line. Advantageously, it is also possible to advance the yarn with its filaments spread over the guide surface.

A good impregnation of the yarn is obtained with a water jet, which is directed toward the yarn under a high pressure on the order of, for example, 7 bar. Another advantage results in that the yarn is flattened or spread by the jet impacting on the same under a high velocity, whereby the yarn is moistened over its entire cross section. The jet of liquid should leave the nozzle with a high velocity. Therefore, the nozzle should preferably open into the atmosphere. In this case, the guide surface for guiding the advancing yarn has to be open in the direction of the jet. If the guide surface is mounted in a yarn guiding channel, the cross section of the yarn guiding channel for achieving a high jet velocity has to be very large, in order to avoid producing slack water and a higher than atmospheric pressure in said channel. Preferably, the guide surface is the surface of a body which is separate from the body of the nozzle means. By the high pressure up to about 7 bar it is achieved that the jet of liquid will impact with high kinetic energy onto the yarn. Preferably, the guide surface is convex transversely to the direction in which the yarn moves. Furthermore, the guide surface may also or alternately have a convex curvature in the direction of the advancing yarn. The advancing yarn is guided in contact with the guide surface. The yarn guide means can be mounted to provide contact over the entire length of the guide surface between the beginning and the end. The size of the impact surface of the water jet on the contact surface is adjusted to the amount of water specifically required for a certain yarn. Subsequently, the filaments are again combined to a yarn, which then advances to the texturing nozzle.

As a result of their spreading, the filaments are deposited on the guide surface in the shape of a web, so that the yarn can be impregnated uniformly and without a loss of water. The amount of water, which serves to moisten the filaments, is defined by the strength and dimensions of the sprayed-on water jet.

Preferably the water jet is in the shape of a cone. To this end, it is possible to use a nozzle, which corresponds to the cross section of the jet, and the opening of which is so configured that a cone of water jets is formed. Its strength and dimension are, for example, determined in that a certain pressure is adjusted before the nozzle and/or that the cross sectional surfaces of the nozzle are varied. The high pressure prevents the nozzle opening from clogging, and in addition, the high pressure permits the amount of water to be precisely measured, since in a plurality of texturing positions, the high pressure is simpler to control and regulate than low pressures as are applied in the known apparatus. Consequently, the advancing yarn is always uniformly moistened. As a result of the present method, it is accomplished that an optimal amount of water is consistently available and distributed over the cross section of the yarn. Thus, the yarn is not wetted with an excessive supply of water.

In a preferred embodiment, the jet of water is produced by a nozzle and spread outwardly to a width such that its surface of impact covers the width of yarn on the guide surface. This procedure has the advantage that any amount of water, including also that which corresponds to the maximum water absorbency of the yarn, can be evenly distributed to an optimal extent over the entire cross section of the yarn, before the yarn enters into the air texturing nozzle. Also, the amount of water can be precisely measured, in that, for example, the pressure can be changed before the nozzle or the nozzle cross section can be varied.

It is also preferred that the water jet be airlessly atomized in the nozzle. This has the advantage that as a result of its atomization the water impregnates the cross section of the yarn in a very fine distribution. To this end, it is suggested that an airless water jet nozzle having a diameter of just a few 1/10 mm be used, which is supplied by a pressure line.

The water pressure delivered to the nozzle is preferably regulated. This has the advantage that a constant supply of water for the yarn or yarns of several texturing positions may be assured. To this end a certain pressure is input as a desired value, which is corrected in the event of a deviation, i.e., when the actual values do not correspond to the desired value. This correction can occur, for example, in that the pump output is changed oppositely to the pressure variation.

A simple pressure regulation may be achieved by utilizing a pump to generate the water pressure, with the pump being pressure regulated. More particularly, the output of the pump may be controlled as a function of the nozzle pressure. Thus, if the nozzle pressure increases, the pump output will become less, or vice versa. Suitable pumps are diaphragm pumps, since they are insensitive to impurities in the water. Preferably, these pumps are operated by compressed air, inasmuch as this controlled source of energy is present on any air texturing machine, it being also advantageous that the air pressure is already regulated to the level required for texturing.

The water jet may be inclined so that the central jet angle is inclined to the yarn axis in such a manner that the jet has a component having an advancing effect on the yarn in its advancing direction. Thus the water jet facilitates the advancing of the yarn. When the jet contacts the guide surface normally to the yarn axis, the angle of the central jet is 90°, and the advancing effect and thus the advancing speed of the yarn can be increased by decreasing the angle of the central jet from the 90° position.

It is preferred that the guide surface projects into the yarn path in such a manner that, as the yarn passes over the surface, it is held against the surface under a longitudinal tension, and that the water jet is forced by means of a pressure pump through the nozzle and sprayed in a direction toward the surface. As a result of the high pressure, the water jet impacts on the yarn and presses the same against the surface. The yarn or respectively the individual filaments thereof cannot escape to the side. Thus, a very precisely measured, optimally uniform impregnation is made possible.

In one embodiment, the guide surface has a slightly convex curvature extending transversely to the direction of the advancing yarn, thereby assisting the spreading of the yarn, which is kept taught in the direction of its advance. In this condition, the yarn offers a good contact surface for the water impregnation.

The jet nozzle preferably produces a cone having a cross section such that all filaments of the yarn lie within the impact surface and are subjected to substantially the same dwell time under the conical jet. This results in all of the filaments absorbing the same amount of water as they pass through below the impact surface.

The cross section of the jet of water may be oval and thus the cone of water impacts with an oval outline on the yarn spreading surface. The width of the oval outline corresponds to the width of the web of filaments, so that the same are also evenly wetted with water.

The water pump may be a double diaphragm pump, which is driven by compressed air having a controllable pressure. This embodiment has the advantage that the height of the water pressure is proportionally dependent on the height of the controlled air pressure, thereby regulating the water pressure to a constant value. The use of a double diaphragm pump provides for a continuous flow of water, and in addition, such a pump is insensitive to impurities in the water.

The avoidance of a clogging risk in accordance with the present invention is significant in a texturing machine having a plurality of texturing positions, since the amount of water can be supplied in precisely measured, optimal quantities to all existing wetting devices.

The central jet angle is preferably adjustable as a function of the yarn speed or yarn material. This is preferably accomplished in that the nozzle which defines the axis of the water jet, can be pivoted relative to the yarn axis. Thus, when pivoting the nozzle, the magnitude of the directional components of the impacting water jet, which are operative in the direction of the advancing yarn, changes, so that, consequently, the advancing effect is adjustable.

BRIEF DESCRIPTION OF THE DRAWINGS

Some of the object and advantages of the present invention having been stated, others will appear as the description proceeds, when taken in conjunction with the accompanying drawings, in which.

DETAILED DESCRIPTION OF THE PREFERRED EMBODIMENTS

Figure 1:
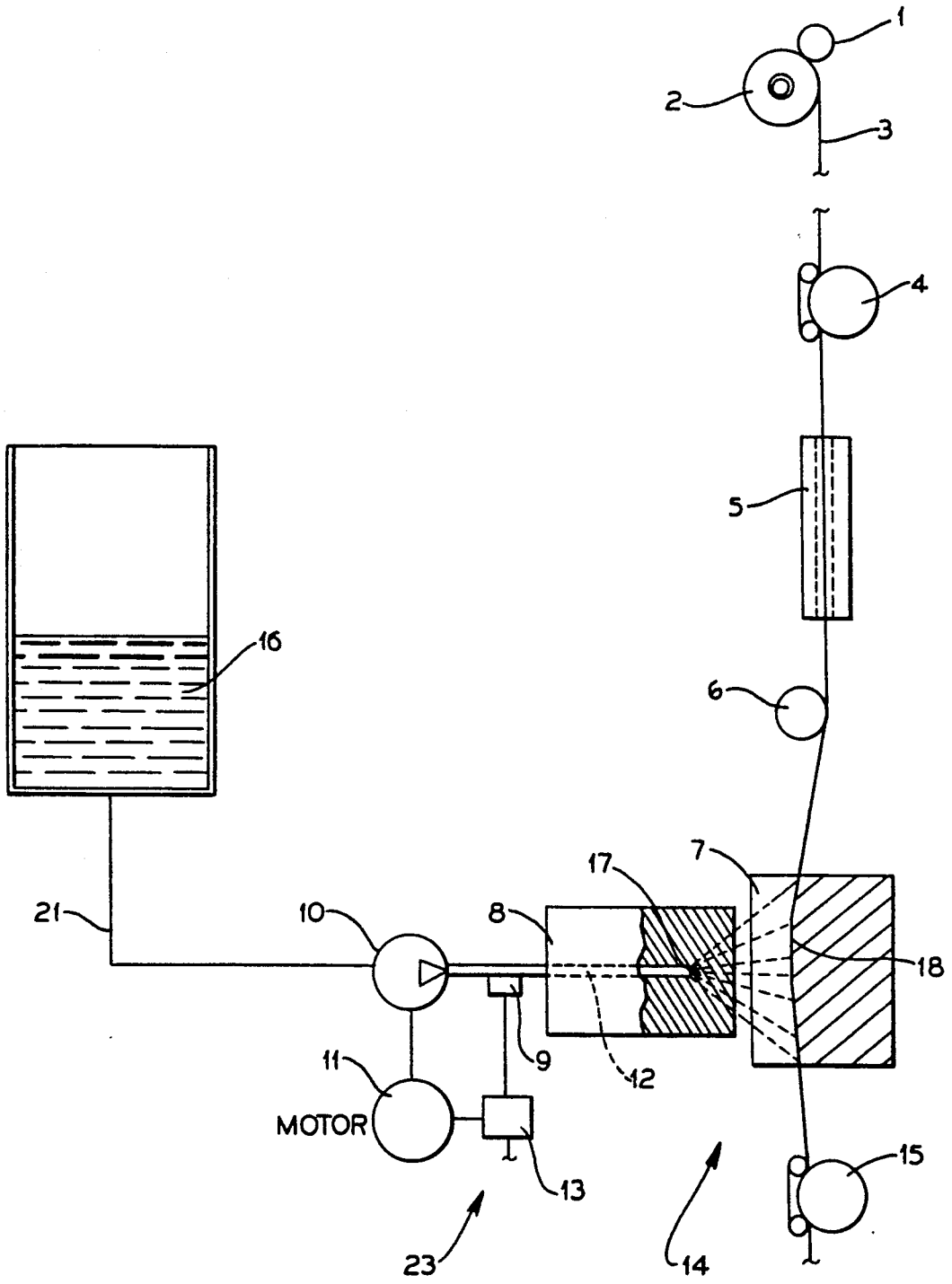
FIG. 1 is a schematic illustration of the texturizing portion of a yarn air texturizing apparatus, and which embodies the present invention.

Referring more particularly to the drawings, FIG. 1 shows a yarn 3, which is guided from a feed roll 15 across a yarn guide 7. In the illustrated embodiment, the yarn advances upwardly from the lower portion of the machine, and after leaving the guide 7, it advances over a deflecting roll 6 to an air texturing nozzle 5, where it is textured to increase its bulk as known in the art. A delivery roll 4 supplies the yarn to a package 2, which is driven anticlockwise by a drive roll 1.

A nozzle block 8 is connected, via a pressure line 12, with a pressure pump 10. The pressure pump is driven, via a motor 11, its driving power being controlled via a controller 13. To this end, a pressure sensor 9 is interposed in pressure line 12, which is connected with controller 13. Another input of the controller is a power supply 23. The output of the controller is its connection to the motor 11. The output is power-controlled, i.e., when the pressure sensor 9 measures a pressure deviating from a desired value, the controller readjusts the motor output, until the actual value corresponds again to the desired value. The pressure pump is connected, via a supply line 21, with a water supply tank 16. As can be seen, the pump delivers the inflowing water into the pressure line 12 under a high pressure. At its end, the pressure line is provided with a nozzle 17, in which the pressure water jet is airlessly atomized, thereby producing a cone of water 14, which, as can be seen, is directed to the surface 18 of the guide shown here in cross section.

Figure 2:
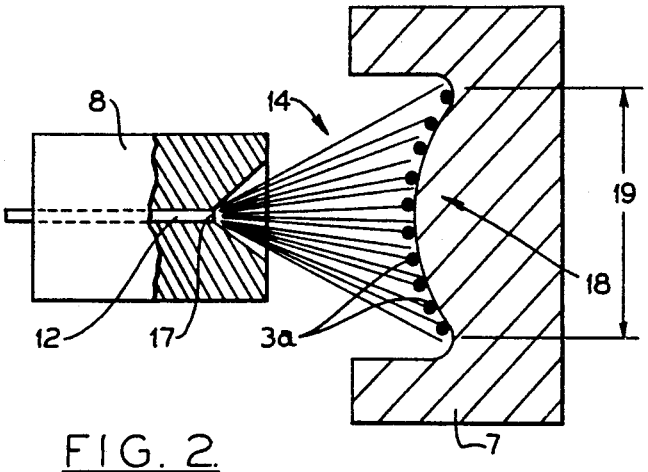
FIGS. 2 and 2A are cross sectional views of two embodiments of the yarn guide surfaces of the present invention.
Figure 2A:
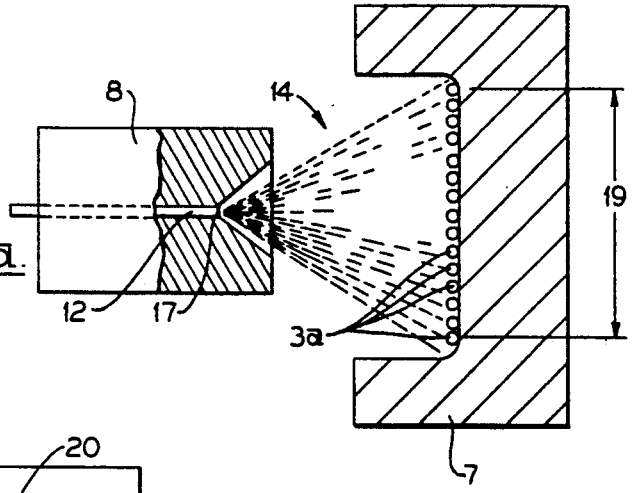

Both FIG. 2 and FIG. 2A illustrate a view of the nozzle block and the guide surface 18 in the direction of the advancing yarn as viewed from the feed roll 15 of FIG. 1. The nozzle block is lengthwise bored, thereby forming the pressure line 12. The pressure line terminates in the nozzle 17, which diverges in direction toward the guide surface 18. As a result of this divergent widening, a cone of water 14 is produced, which applies the water in a finely distributed form to the guide surface across its width 19, thereby uniformly moistening the filaments. The difference between FIGS. 2 and 2A is that in the case of FIG. 2 the guide 7 has a surface 18 which is slightly curved transverse to the direction of the advancing yarn. This surface is arcuately curved in such a manner that the yarn being under a tension is spread into its individual filaments. In contrast thereto, FIG. 2A shows a surface extending in a straight line across the width 19, over which the spread yarn advances.

Figure 3:
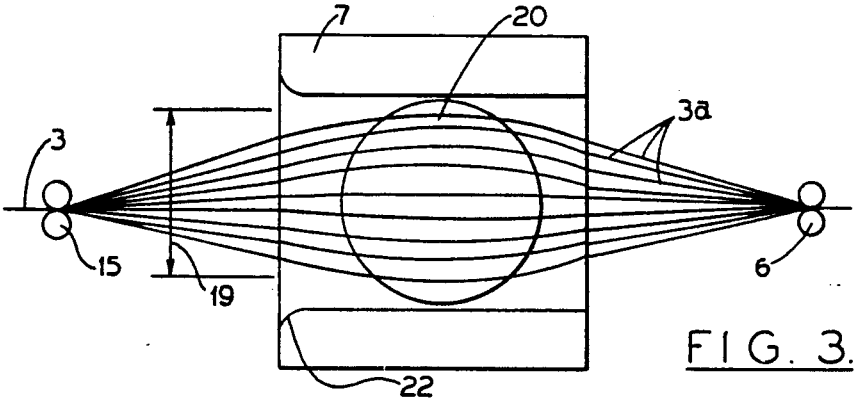
FIG. 3 is a front elevational view of a yarn guide surface and illustrating a circular cone of the water jet.

FIG. 3 is a schematic view of the guide surface viewed from the direction of the nozzle. The yarn 3 is supplied to the feed roll 15 in a combined form. Between the feed roll 15 and the deflecting roll 6, the yarn is kept under such a longitudinal tension that its filaments 3*a* spread laterally over the width 19 of the surface. As can be seen, the cross section of the water jet is circular, i.e., the water jet forms a circular impact outline 20 on the spread filaments. Also, on its yarn entry side, the guide has a rounded inlet end 22.

Figure 4:
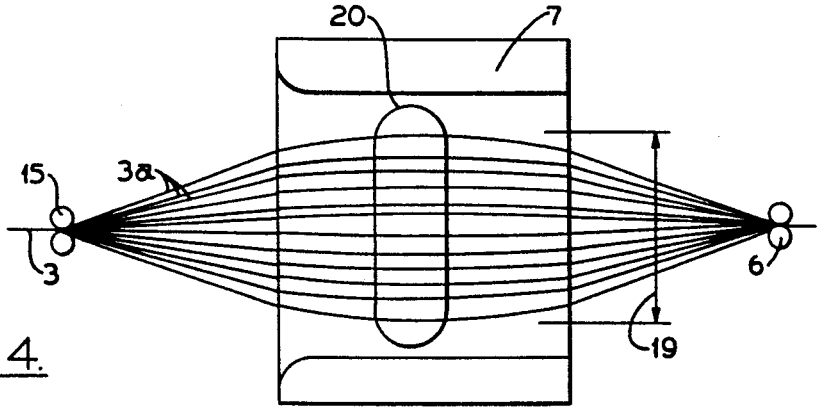
FIG. 4 is a view similar to FIG. 3 but wherein the water jet has an oval cone.

In the embodiment of FIG. 4, the cross section of the water jet is a cone with an oval cross section, so that the spread filaments are uniformly moistened across the entire width 19. As the filaments travel across the guide surface, they are all subjected to identical dwelling times under the cone of water jets.

Figure 5:
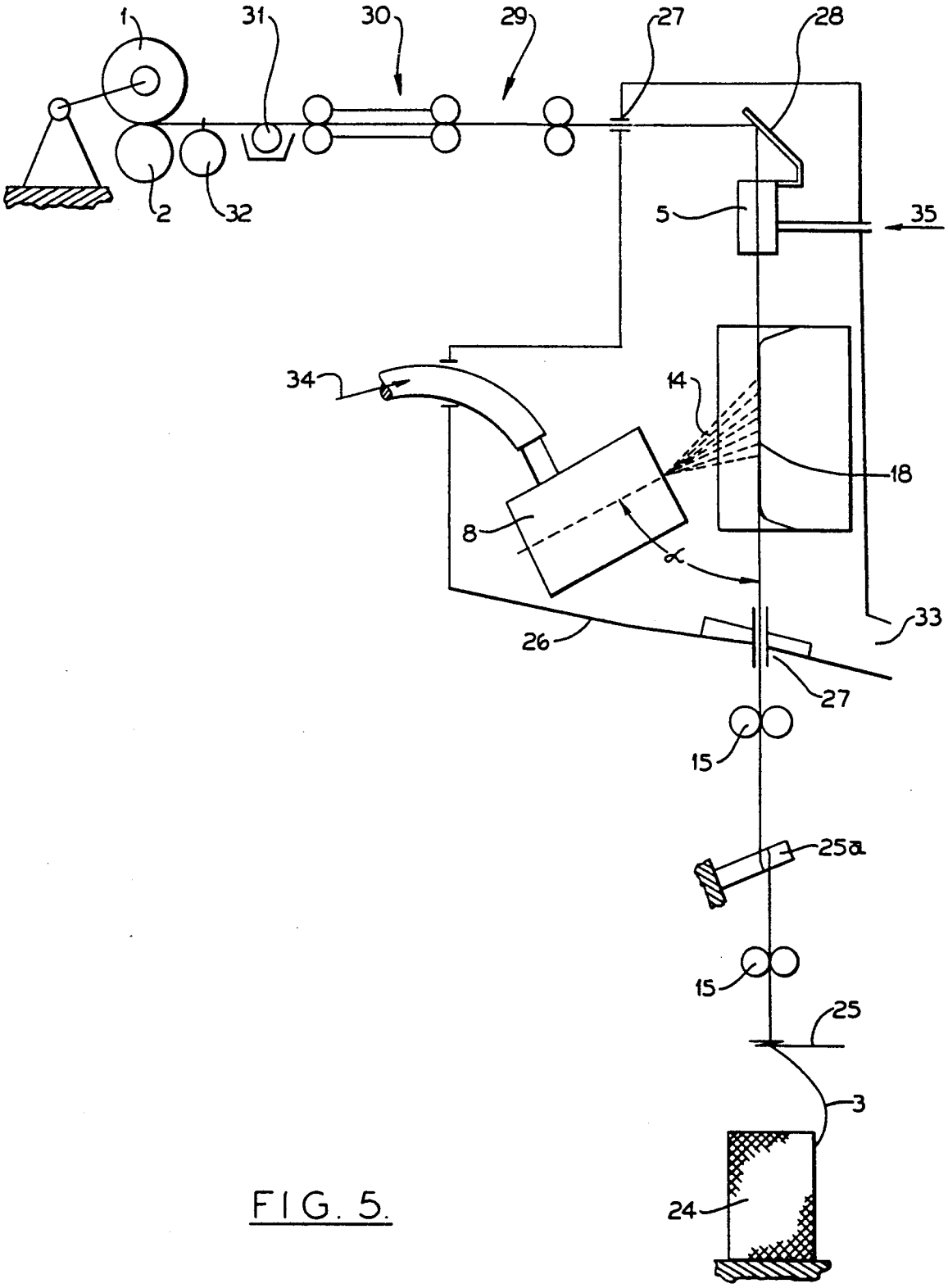
FIG. 5 is a schematic illustration of an air texturing machine and having provision or adjusting the central jet angle of the water jet.

FIG. 5 illustrates the yarn 3, which is supplied from a supply package 24 through an eyelet 25 to the feed systems 15. Arranged between the two feed systems 15 is a draw pin 25*a*. After leaving the second feed system, the yarn enters through a passage 27 into a housing 26. Inside the housing, the yarn first travels over the guide surface 18 and is there moistened in the manner described above. However, here the jet is applied to the yarn at a central jet angle alpha, which is less than 90°. To this end, the nozzle block is inclined to the axis of the advancing yarn in such a manner that the impacting water jet contacts the surface with a component in a direction toward the subsequent air texturing nozzle 5. The nozzle block is connected, via a pressure water hose 34, with a pressure pump, as described above. After leaving the guide surface, the advancing yarn enters into the air texturing nozzle 5, where it is textured. The air texturing nozzle has a compressed-air connection 35, which, as does the pressure water hose 34, extends to the outside of the housing 26. Viewed in the direction of advance of the yarn, the yarn impacts a surface 28 subsequent to the air texturing nozzle, where it is deflected outwardly to the left in a direction toward an upper outlet passage 27. The yarn leaves the housing through passage 27 and is then subjected to further processing steps, such as drawing at 29, heat setting at 30 and oiling at 31. A traversing system 32 for the advancing yarn precedes its takeup on the package 2 by means of drive roll 1.

The bottom of the housing is inclined with respect to the horizontal in such a manner that any leaking water which may develop, for example, from the spray mist, can be drained through an outlet opening 33.

Figure 6:
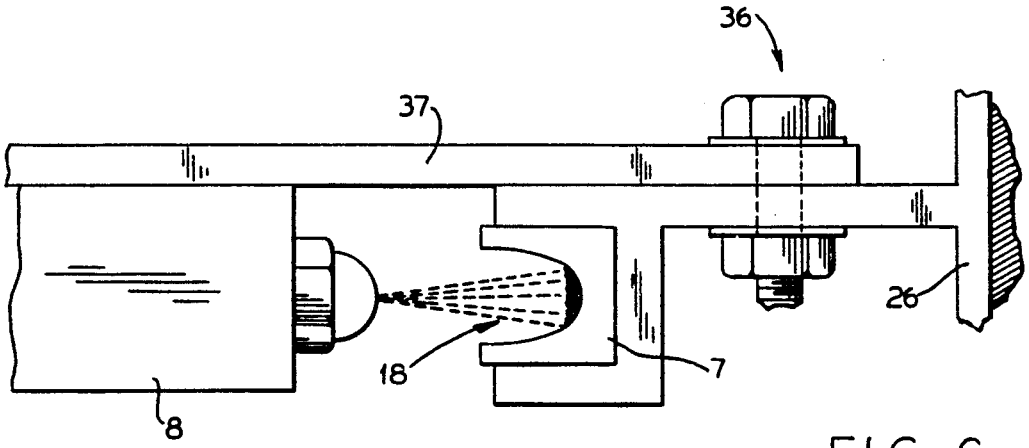
FIG. 6 is a top plan view illustrating an adjustable nozzle and associated guide surface.

FIG. 6 illustrates a schematic view of a mounting arrangement suitable for adjusting the central jet angle, as seen in the direction of the advancing yarn. To this end, the guide 7 is fixedly mounted to the housing 26. A releasable connection 36 permits a holder 37 for the nozzle 8 to pivot about a horizontal axis until the angle of the central jet has reached a desired value. In the illustrated embodiment, the central jet angle extends parallel to the pivotal plane and can therefore not be shown. However, this angle may be seen in the foregoing FIG. 5.

Figure 7:
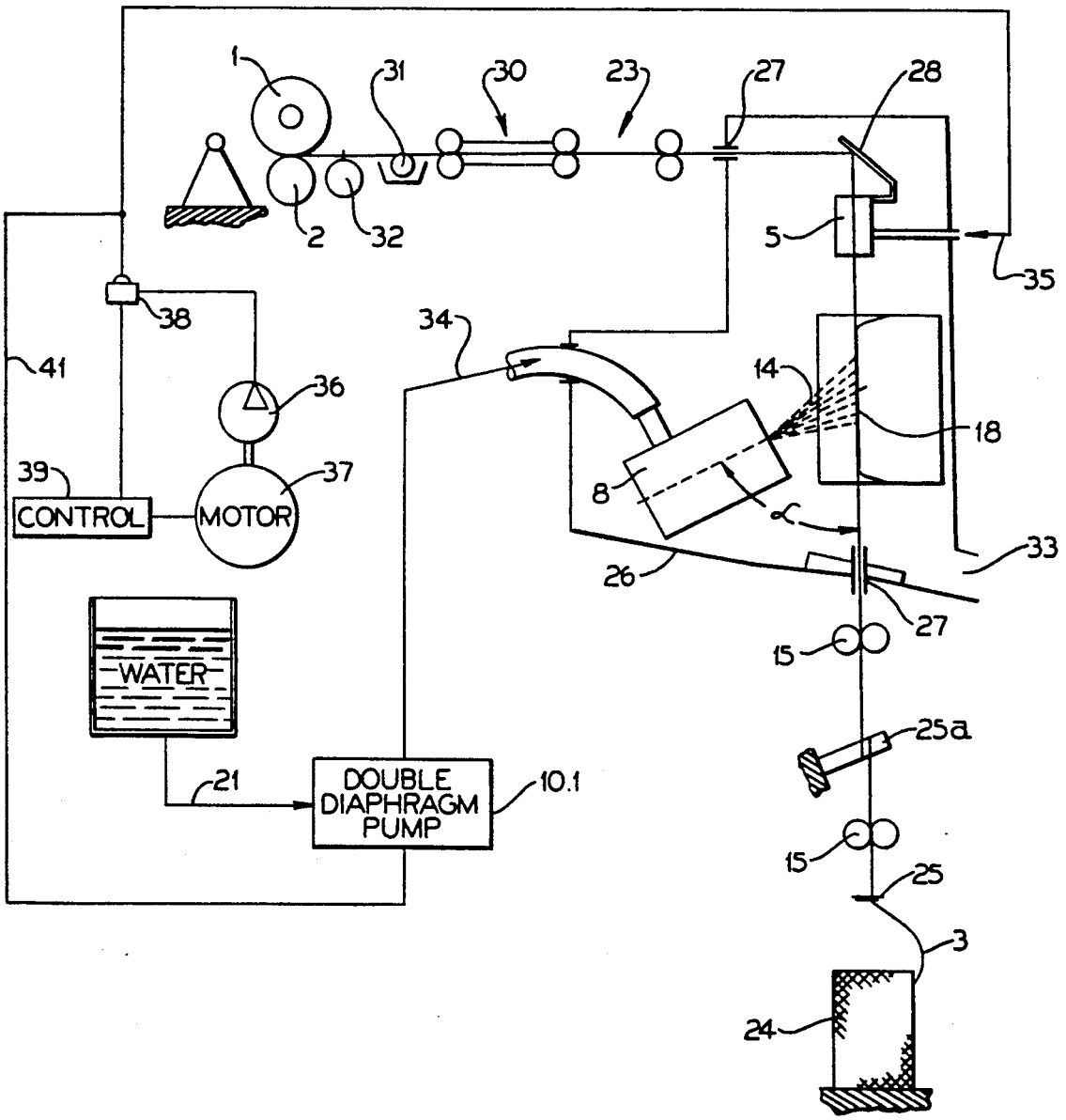
FIG. 7 is similar to FIG. 5, but additionally illustrates the water and air supply systems.

The illustration of FIG. 7 corresponds substantially to that of FIG. 5. To this extent the description of FIG. 5 also applies to FIG. 7. However, the latter illustrates supplementarily a compressed-air operated double diaphragm pump 10.1, which is driven by the controlled air pressure of the air texturing machine. To this end, a compressed-air pump 36, which is driven by a motor 37, is connected to the compressed-air inlet 35. The output signal of the compressed-air pump 36 is read by a pressure pickup 38 and supplied to a controller 39. The controller again regulates the motor speed, which proportionately influences the pump output. In such a texturing machine, it is necessary to regulate the air pressure for texturing the yarn to a constant value. Thus, a controlled air pressure is applied to the compressed-air connection 35, which is tapped, via a control line 41 for the operation of the double diaphragm pump. The inlet end of the diaphragm pump is connected, via a supply line 21, with a water tank. The outlet end of the double diaphragm pump is the pressure water connection 34, which connects directly to the nozzle block 8. With regard to details of such a double diaphragm pump reference is made to FIG. 8.

Figure 8:
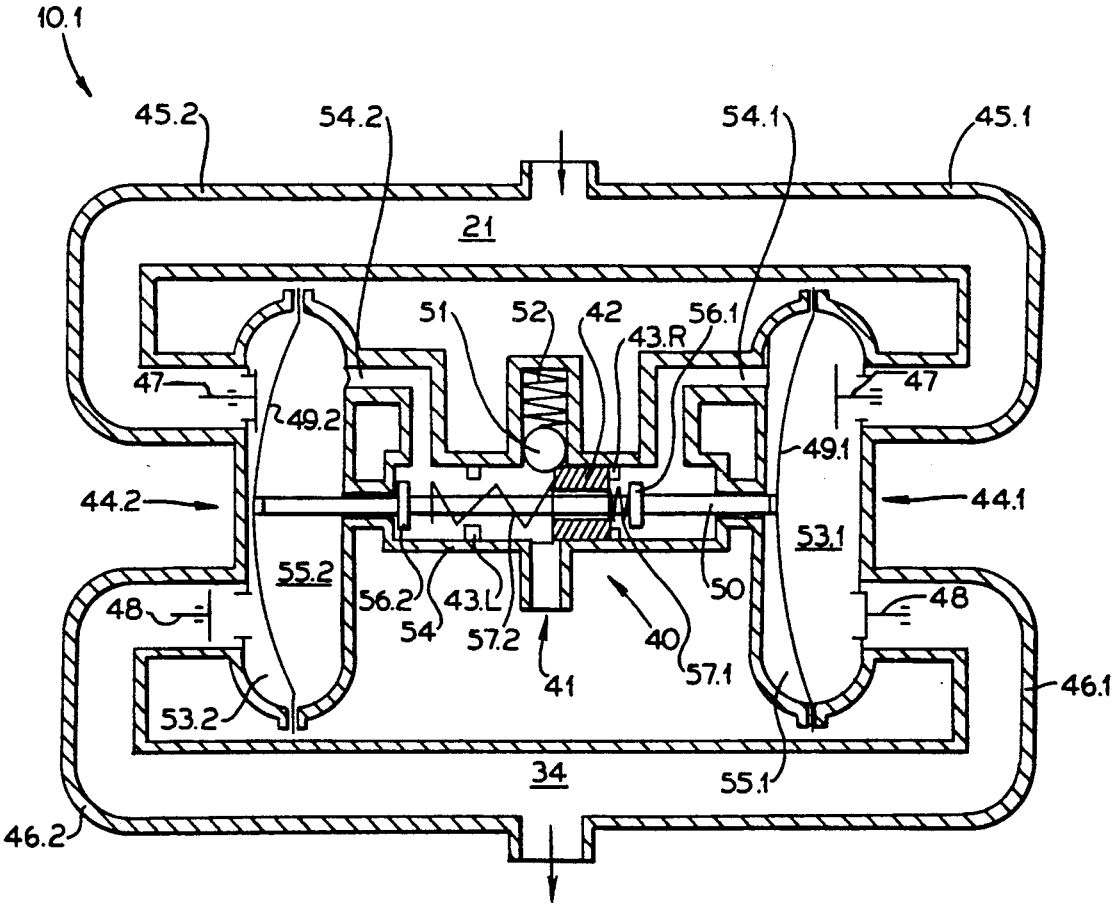
FIG. 8 is a sectional view of a double diaphragm pump for use with the present invention.

FIG. 8 is a detail drawing of a compressed-air operated double diaphragm pump, which is constructed symmetrically to a vertically assumed axis. It comprises two identical pump housings 44.1, 44.2. Each pump housing forms a cylindrical, hollow space and is subdivided respectively by a diaphragm 49.1, 49.2 in its central radial plane. The diaphragm is tightly clamped into the outer periphery between the superposed halves of each pump housing. A common pump rod 50 interconnects both diaphragms in such a manner that same must always carry out a unidirectional motion. This means that the pump motions of the diaphragms are interdependent. Each pump housing possesses an inlet passage 45.1 and 45.2 respectively. Both inlet passages are connected to the common supply line 21. As can be seen in FIG. 7, the supply line 21 is connected with a supply tank. Located in each transition from the inlet channel 45.1 or 45.2 respectively to the associated valve housing 44.1 or 44.2 is a forcibly controlled inlet valve 47, which opens or seals by forced control the respective pump pressure chamber 53.1 or 53.2 against the associated inlet passage 45.1 or 45.2. In like manner, each pump housing possesses another pump connection, which is constructed as an outlet passage 46.1 and 46.2 respectively. Both outlet passages terminate in the common pressure water connection 34.

As can be seen, for example, in FIG. 7, the pressure water connection 34 supplies the pressure water directly to the nozzle block 8. Arranged in each transition from the pump housing to each associated outlet passage 46.1 and 46.2 is an automatically opening outlet valve 48. As aforesaid, the movements of the two diaphragms 49.1 and 49.2 are interconnected. A compressed-air unit 40, which substantially comprises a cylinder-piston assembly 54, serves to operate the diaphragms of the pump in the sense of a pump motion.

Inside the cylinder-piston assembly, a flying piston 42 is movably guided between its two end positions, which are each defined by a stop 43.L and 43.R. In its end positions, the flying piston 42 is held by a sphere 51 under spring tension against the respective stop. The compression of spring 52 allows the flying piston to move along the cylinder between its end positions. In so doing, it passes over the control line 41 in such a manner that it comes to lie, in its one or other end position, on respectively one side of the control line.

Connecting channels 54.1 and 54.2 of the cylinder-piston assembly are associated respectively to each diaphragm pump outside of the path traveled by the flying piston. As can be seen, the flying piston releases in each of its two end positions the connection from the control line 41, via one of the two connecting channels 54.1 or 54.2, to the working chamber 55.1 or 55.2 respectively connected thereto. The flying piston is provided with a bore extending through its center in axial direction and displaceable along the pump rod 50. Outside of the path traveled by the flying piston, two abutments 56.1 and 56.2 are arranged on the pump rod 50, a compression spring 57.1 or 57.2 being respectively supported on the side of each abutment, which faces the flying piston. The flying piston 42 is movable relative to the piston rod 50 and biases during its motion respectively one of the two compression springs 57.1 or 57.2.

In operation, compressed air is supplied to the control line 41. In the illustrated end position of the flying piston 42, the connection to the working chamber 55.2 of the pump is released via the connecting channel 54.2, so that compressed air is applied to this working chamber of the pump. Under the action of the applied pressure, the movably guided diaphragm yields in the sense of decreasing the pump pressure chamber 53.2. Consequently, while the outlet valve 48 opens simultaneously, the flow medium is pushed into the outlet passage 46.2 to the pressure water connection 34. Along with the movement of the diaphragm 49.2 in the sense of reducing the pump pressure chamber 53.2, the pump rod 50 displaces correspondingly, thereby moving the diaphragm of the second diaphragm pump in the sense of decreasing the working chamber 55.1 of the pump, on the one hand, and moving along the abutment 56.1 in direction to the flying piston, on the other. As a result of the decrease of the spacing between the abutment 56.1 and the flying piston 42, the compression spring 57.1 is tensioned. Thus, the flying piston is under the tension of compression spring 57.1, but is, for the time being, still prevented from yielding by the spring-biased sphere 51. As the tension of the compression spring 57.1 continues to increase, the flying piston yields, while compressing the spring 52, in direction to its opposite end position. In so doing, it passes over the inlet opening of the control line 41 into the cylinder. In this moment, the connection of the control line 41 to the connecting channel 54.2 is interrupted. The compression spring 57.1, which continues to be biased, pushes the flying piston to its opposite end position, thereby releasing the connection of the control line 41, via connecting channel 54.1, to the second working chamber 55.1 of the pump. This working chamber is now supplied with the air pressure from the control line 41, and the aforesaid procedure repeats itself accordingly. The pump pressure chamber 53.2 is increased through the pump rod 50, so that an underpressure develops, which causes the inlet valve 47 to open. Through inlet valve 47, the pump pressure chamber 53.2 is again filled with water, whereas the previously filled pump pressure chamber 53.1 is now emptied into the pressure water connection 34.

In the drawings and specification, there have been set forth preferred embodiments of the invention, and although specific terms are employed, they are used in a generic and descriptive sense only and not for purposes for limitation.

That which is claimed is:

1. A method of processing a synthetic continuous filament yarn comprising the steps of advancing the yarn along a path of travel, guiding the advancing yarn across a fixed guide surface in a tensioned condition, while spreading the advancing yarn laterally as it is guided over the guide surface, wetting the advancing yarn by directing a jet of liquid onto the yarn as it advances across the guide surface and from a direction generally opposing the guide surface, and guiding the wetted yarn through an air texturing nozzle to impart bulk to the wetted yarn.

2. A method as defined in claim 1 wherein the step of wetting the yarn includes forming the liquid jet into a diverging generally conical pattern so as to cover the full width of the advancing yarn, and such that all filaments of the advancing yarn are subjected to substantially the same dwell time under the conical jet.

3. The method as defined in claim 1 wherein the step of wetting the yarn includes airlessly atomizing the jet of liquid.

4. The method as defined in claim 1 wherein the step of wetting the advancing yarn includes inclining the jet of liquid so as to have a directional component in the direction of the advancing yarn.

5. The method as defined in claim 1 comprising the further step of controlling the amount of liquid applied to the advancing yarn so as to

6. The method as defined in claim 1 wherein the jet of liquid comprises water.

7. An apparatus for processing a synthetic continuous filament yarn comprising means for advancing a yarn along a path of travel, guide surface means positioned along said path of travel and such that the advancing yarn is advanced thereacross in a tensioned condition, nozzle means including a nozzle positioned adjacent and generally opposed to said guide surface for directing a jet of liquid onto the advancing yarn as it advances across the guide surface, and including a liquid supply, a liquid line extending between said supply and said nozzle, a liquid pump disposed in said line for conveying the liquid under pressure to said nozzle, a pressure sensor operatively connected to said liquid line, and controller means responsive to said sensor for controlling the speed of said pump and thus the pressure in said liquid line delivered to said nozzle, and air jet texturizing means mounted along said path of travel downstream along said guide surface for imparting bulk to the wetted advancing yarn.

8. The apparatus as defined in claim 7 wherein said liquid pump is a double diaphragm pump which is driven by compressed air and wherein said air jet texturizing means and said diaphragm pump are connected to an air supply line under a controllable pressure.

9. The apparatus as defined in claim 7 further comprising means mounting said nozzle with respect to said guide surface such that the angle at which the jet of liquid approaches the guide surface may be adjusted and so that the jet of liquid may be inclined to have a directional component in the direction of the advancing yarn.

10. The apparatus as defined in claim 7 wherein said guide surface is relatively broad and is positioned so as to cause the advancing yarn to spread laterally as it passes thereover.

11. The apparatus as defined in claim 10 wherein said guide surface is arcuately curved in cross section when viewed in the direction of the advancing yarn.

12. The apparatus as defined in claim 7 wherein said guide surface is arcuately curved in the direction of the advancing yarn.

13. The apparatus as defined in claim 7 wherein said jet and said yarn have their axes lying in a plane which is perpendicular to said guide surface.

14. A method of processing a synthetic continuous filament yarn comprising the steps of advancing the yarn along a path of travel, guiding the advancing yarn across a fixed guide surface in a tensioned condition.

wetting the advancing yarn by directing a jet of liquid onto the yarn as it advances across the guide surface and from a direction generally opposing the guide surface, and including airlessly atomizing the jet of liquid, and guiding the wetted yarn through an air texturing nozzle to impart bulk to the wetted yarn.

15. A method of processing a synthetic continuous filament yarn comprising the steps of advancing the yarn along a path of travel, guiding the advancing yarn across a fixed guide surface in a tensioned condition, wetting the advancing yarn by directing a jet of liquid onto the yarn as it advances across the guide surface and from a direction generally opposing the guide surface, and including inclining the jet of liquid so as to have a directional component in the direction of the advancing yarn, and guiding the wetted yarn through an air texturing nozzle to impart bulk to the wetted yarn.

16. An apparatus for processing a synthetic continuous filament yarn comprising means for advancing a yarn along a path of travel, guide surface means positioned along said path of travel and such that the advancing yarn is advanced thereacross in a tensioned condition, nozzle means including a nozzle positioned adjacent and generally opposed to said guide surface for directing a jet of liquid onto the advancing yarn as it advances across the guide surface, and including a liquid supply, a liquid line extending between said supply and said nozzle, a liquid pump disposed in said line for conveying the liquid under pressure to said nozzle, and wherein said liquid pump is a double diaphragm pump which is driven by compressed air, and air jet texturizing means mounted along said path of travel downstream along said guide surface for imparting bulk to the wetted advancing yarn, and wherein said air jet texturizing means and said diaphragm pump are connected to an air supply line under a controllable pressure.

17. An apparatus for processing a synthetic continuous filament yarn comprising means for advancing a yarn along a path of travel, guide surface means positioned along said path of travel and such that the advancing yarn is advanced thereacross in a tensioned condition, nozzle means including a nozzle positioned adjacent and generally opposed to said guide surface for directing a jet of liquid onto the advancing yarn as it advances across the guide surface, air jet texturizing means mounted along said path of travel downstream along said guide surface for imparting bulk to the wetted advancing yarn, and means mounting said nozzle with respect to said guide surface such that the angle at which the jet of liquid approaches the guide surface may be adjusted and so that the jet of liquid may be inclined to have a directional component in the direction of the advancing yarn.

18. An apparatus for processing a synthetic continuous filament yarn comprising means for advancing a yarn along a path of travel, guide surface means positioned along said path of travel and such that the advancing yarn is advanced thereacross in a tensioned condition, said guide surface means being relatively broad and positioned so as to cause the advancing yarn to spread laterally as it passes thereover, nozzle means including a nozzle positioned adjacent and generally opposed to said guide surface for directing a jet of liquid onto the advancing yarn as it advances across the guide surface, and air jet texturizing means mounted along said path of travel downstream along said guide surface for imparting bulk to the wetted advancing yarn.

19. An apparatus for processing a synthetic continuous filament yarn comprising means for advancing a yarn along a path of travel, guide surface means positioned along said path of travel and such that the advancing yarn is advanced thereacross in a tensioned condition, said guide surface means being arcuately curved in the direction of the advancing yarn, nozzle means including a nozzle positioned adjacent the generally opposed to said guide surface for directing a jet of liquid onto the advancing yarn as it advances across the guide surface, and air jet texturizing means mounted along said path of travel downstream along said guide surface for imparting bulk to the wetted advancing yarn.

* * * * *

UNITED STATES PATENT AND TRADEMARK OFFICE

CERTIFICATE OF CORRECTION

PATENT NO. : 5,003,677

DATED : April 2, 1991

INVENTOR(S) : Eberhard Krenzer

It is certified that error appears in the above-identified patent and that said Letters Patent is hereby corrected as shown below:

Column 8, line 54, after "to" (second occurrence), insert -- achieve substantially uniform wetting of the filaments without excessive wetting. --

Signed and Sealed this

Twenty-ninth Day of December, 1992

*Attest:*

DOUGLAS B. COMER

*Attesting Officer*

*Acting Commissioner of Patents and Trademarks*